US007971579B2

(12) United States Patent
Heald et al.

(10) Patent No.: US 7,971,579 B2
(45) Date of Patent: Jul. 5, 2011

(54) AIR-EXHAUST MIXING APPARATUS

(75) Inventors: Brett Heald, Indianapolis, IN (US); Alex Woods, Columbus, IN (US)

(73) Assignee: Cummins Intellectual Properties, Inc., Columbus, IN (US)

( * ) Notice: Subject to any disclaimer, the term of this patent is extended or adjusted under 35 U.S.C. 154(b) by 107 days.

(21) Appl. No.: 12/393,366

(22) Filed: Feb. 26, 2009

(65) Prior Publication Data

US 2009/0217915 A1 Sep. 3, 2009

Related U.S. Application Data

(60) Provisional application No. 61/031,542, filed on Feb. 26, 2008.

(51) Int. Cl.
*F02B 47/08* (2006.01)
*F02B 47/00* (2006.01)

(52) U.S. Cl. ..... 123/568.17

(58) Field of Classification Search ..... 123/568.17, 123/568.18, 568.11, 585, 590, 568.15; 701/108; 60/278, 280, 298, 605.1, 605.2
See application file for complete search history.

(56) References Cited

U.S. PATENT DOCUMENTS

| | | | | |
|---|---|---|---|---|
| 5,207,714 | A * | 5/1993 | Hayashi et al. | 123/568.17 |
| 6,513,508 | B2 * | 2/2003 | Fischer et al. | 123/568.17 |
| 6,938,560 | B2 | 9/2005 | Okazaki et al. | |
| 7,389,770 | B2 * | 6/2008 | Bertilsson et al. | 123/568.17 |
| 7,730,878 | B2 * | 6/2010 | Shieh et al. | 123/568.17 |
| 2008/0264060 | A1 | 10/2008 | Carlsson | |

FOREIGN PATENT DOCUMENTS

DE 10202612 A1 * 7/2003

* cited by examiner

*Primary Examiner* — Mahmoud Gimie
(74) *Attorney, Agent, or Firm* — Studebaker & Brackett PC; Tim L. Brackett, Jr.; J. Bruce Schelkopf

(57) ABSTRACT

An apparatus for mixing intake air and exhaust gases of an internal combustion engine includes a chamber having an inlet to supply a stream of intake air, and a second inlet that receives an exhaust gas flow. The second inlet includes a section extending into the chamber of the mixer that has an outer surface that is elongated in cross-section along a longitudinal axis of the chamber in the direction of flow of the flowable media. The mixing apparatus mixes the intake air and exhaust gases without high pressure head loss across the apparatus.

7 Claims, 6 Drawing Sheets

AIR-EXHAUST MIXING APPARATUS

RELATED APPLICATIONS

This application claims benefit of priority to Provisional Patent Application No. 61/031,542, filed on Feb. 26, 2008, the entire contents of which are hereby incorporated by reference.

FIELD OF THE INVENTION

An apparatus for mixing intake air and exhaust gas in an internal combustion engine system, is disclosed.

BACKGROUND

EGR (Exhaust Gas Recirculation) systems are used by major diesel engine manufacturers to reduce emissions of undesirable nitrogen oxides ($NO_x$) from diesel engines. Depending on engine operating conditions, these systems can divert from about 5 to 50 percent of an engine's exhaust stream through a cooler, and then back into the combustion chambers, where the cooled gases reduce peak temperatures, and thus retard $NO_x$ formation.

SUMMARY

Embodiments consistent with the claimed invention relate to an apparatus for mixing intake air and exhaust gas.

Exemplary embodiments of an apparatus for mixing intake air and exhaust gas of an internal combustion engine and include a chamber having an air inlet port to supply a stream of intake air and an exhaust inlet port including a section extending into the chamber. The section of the exhaust port extending into the chamber has a cross-section that is elongated along a longitudinal axis of the chamber in the direction of flow of the intake air stream.

It is to be understood that both the foregoing general description and the following detailed description are exemplary and exemplary only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention. In the drawings.

DETAILED DESCRIPTION

The various aspects are described hereafter in greater detail in connection with a number of exemplary embodiments to facilitate an understanding of the invention. However, the invention should not be construed as being limited to these embodiments. Rather, these embodiments are provided so that the disclosure will be thorough and complete, and will fully convey the scope of the invention to those skilled in the art.

Figure 1:
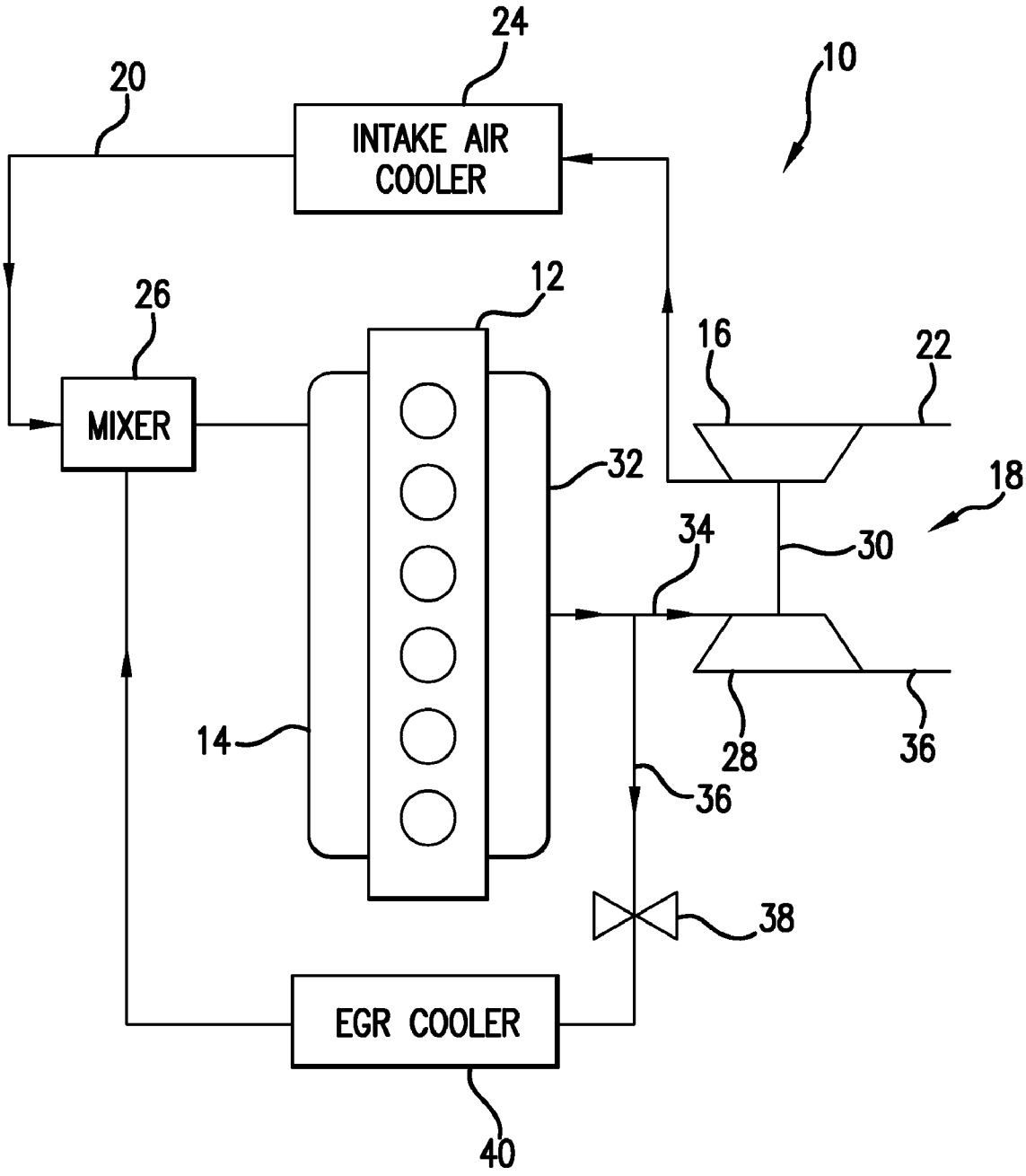
FIG. 1 is a schematic diagram showing an engine including a mixer apparatus in accordance with an exemplary embodiment.

FIG. 1 shows an exemplary internal combustion engine system 10 that can include embodiments of an air-exhaust mixer apparatus described herein. The internal combustion engine system 10 includes internal combustion engine 12 having an intake manifold 14 fluidly coupled to compressor 16 of turbocharger 18 via intake conduit 20. The compressor 16 may receive fresh air from fresh air conduit 22. System 10 also can include an air intake cooler 24 disposed in line with intake conduit 20 between compressor 16 and intake manifold 14. Compressed air passes through cooler 24 to mixer 26 where it is then combined with recirculated exhaust gas (i.e., EGR).

As shown in FIG. 1, the turbocharger compressor 16 is mechanically coupled to turbocharger turbine 28 via a driveshaft 30. The turbine 28 is fluidly coupled to exhaust manifold 32 via exhaust manifold conduit 34 and is further in fluid connection with ambient air via exhaust conduit 35. Exhaust manifold conduit 34 is fluidly coupled to mixer 26 via EGR conduit 36 having an EGR valve 38 disposed in line therewith. An EGR cooler 40 can be disposed between valve 38 and the mixer 26 to cool the exhaust gas before the mixer 26 combines it with the intake air.

A portion of the exhaust gas exiting engine 12 through exhaust manifold 32 may pass through the EGR valve 38, which may be any device useful for regulating the flow of gaseous material, e.g., a throttle, intake valve, exhaust valve or variable valve. Thus, a portion of the exhaust gas may be diverted through the EGR cooler 40 disposed between valve 38 and intake conduit 20. Valve 38 is controlled to regulate the EGR quantity so as to achieve an EGR ratio set in accordance with the operating conditions of internal combustion engine 12 and the desired emissions.

Figure 2:
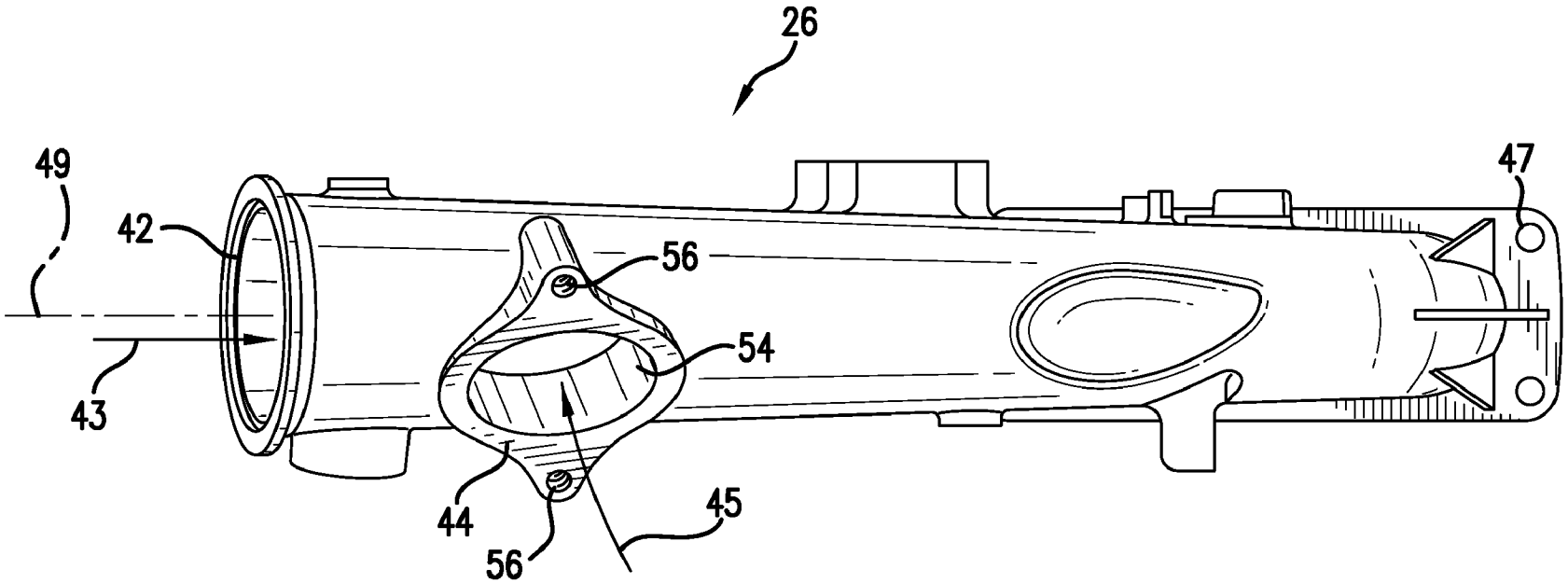
FIG. 2 is a side view of an air-exhaust gas mixer apparatus in accordance with an exemplary embodiment.
Figure 3:
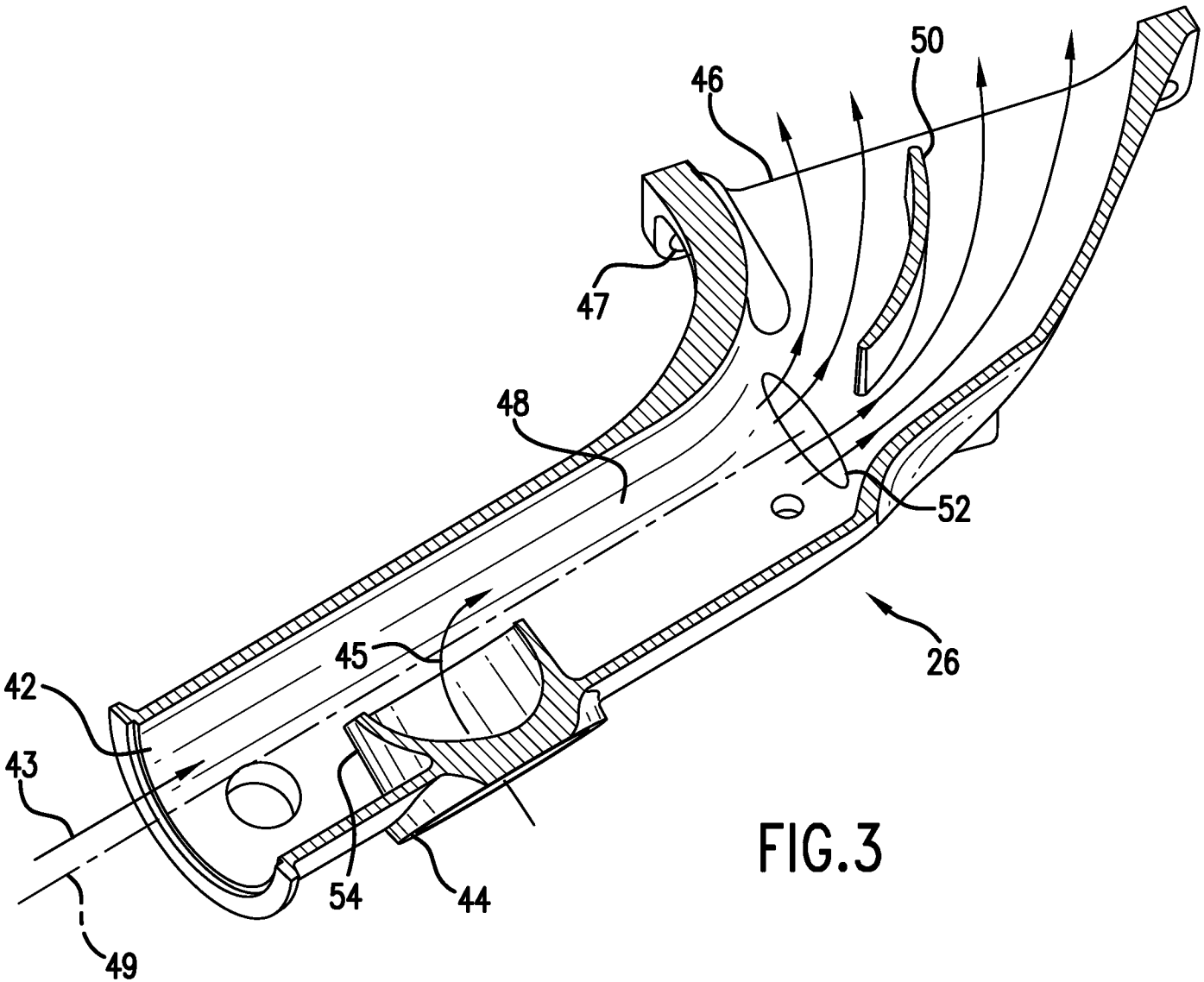
FIG. 3 is a top view in cross-section of the air-exhaust gas mixer apparatus shown FIG. 2.
Figure 4:
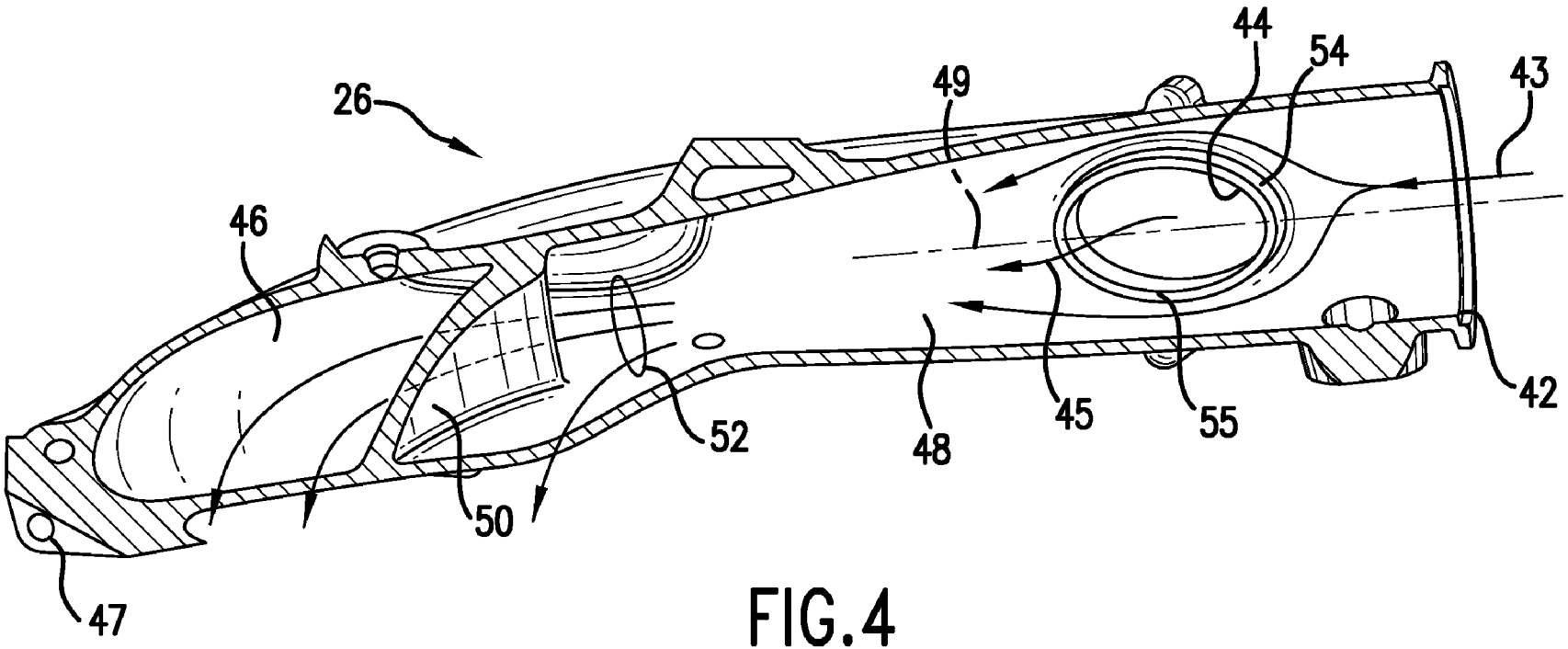
FIG. 4 is a view in cross-section of a side of the air-exhaust gas mixer apparatus opposite the side shown in FIG. 2.

FIGS. 2-4 show an air-exhaust gas mixer apparatus 26 according to an exemplary embodiment. Referring first to the side view perspective of FIG. 2, the air-exhaust mixer apparatus 26 includes an air intake inlet port 42 for receiving intake air that flows into a chamber of the apparatus 26 in the direction of the arrow 43. On the side of the mixer apparatus is an exhaust inlet port 44 for receiving recirculated exhaust gas that flows into the mixer housing in the direction of arrow 45 from EGR conduit 36.

With reference to FIGS. 2 and 3, an outlet port 46 is shown located at an end of the chamber 48 opposite the inlet port, with the exhaust gas inlet port 44 located along the flow path between the air intake inlet port 42 and the outlet port 46. A portion of the adjacent outlet port 46 includes a flange having holes 47 for securing the apparatus 26 to an intake manifold of an internal combustion engine, such as intake manifold 14, although the outlet port 46 can be secured to another conduit component located in the path to the engine intake manifold. The exhaust gas entering the exhaust gas inlet port 44 mixes with the intake air from the air intake inlet port 42, and the resulting air-exhaust mixture exits the outlet port 46 along a flow path shown by the arrows 52. As shown in FIG. 3, the outlet port 46 can include a dividing structure 50 to guide the air-exhaust gas mixture flow and provide substantially uniform pressure distribution of gas exiting the outlet port by reducing an amount of the air-exhaust gas mixture that can accumulate toward the outer edges of the apparatus 26 at the outlet port 46, and thus minimizing the pressure difference across the flow path 52.

As shown in FIGS. 2, 3 and 4, the exhaust gas inlet port 44 can include a section 54 extending, or projecting, into the chamber, for example, at an angle substantially perpendicular to the direction of primary flow of the intake air stream 43, although other orientations could also be used. The section 54 of the exhaust inlet port promotes turbulence of the intake air, and thus mixing of the intake air and entering exhaust gas. Also, FIG. 4 shows a cross-section 55 of the exhaust gas inlet port 44, which includes an outer surface shaped to have a distance between the two points on the outer surface most distant from one another in a first direction along the general direction of the intake air flow, or parallel to the axis 49, greater than a distance between the two most distant points on the outer surface in a second direction substantially perpendicular to the first direction. In one embodiment, the outer surface of projected section 54 is elliptical in shape, with the major axis of elliptical cross-section in the same direction as the direction of the intake air stream 43 or longitudinal axis 49 of the chamber 48.

As can be seen in FIG. 4, the elongated shape of the exhaust gas inlet port outer surface allows the intake air flowing around the projected section 54 of the exhaust gas inlet 44 to create enough increased turbulence in the intake air to cause enhanced mixing while maintaining a low pressure head loss. By maximizing the area defined in its perimeter by the inner surface of the cross section 55, the flow of recirculated exhaust gas 45 can be correspondingly maximized. Additionally, by minimizing the outer surface of the annular cross section 55, a low pressure head loss is maintained by facilitating an unimpeded intake air flow.

The exhaust gas inlet port section 54 preferably protrudes to an extent reaching about halfway or slightly less than half the distance across the effective diameter of the mixing chamber 48, although it may protrude to a greater or lesser amount. For example, for a chamber effective diameter of 90 mm, the exhaust gas inlet port section 54 extends to at most about 10 mm from the chamber axis 49. However, having no protrusion would result in poor mixing of the exhaust gas and intake air because the exhaust gas would cling along the adjoining chamber wall after entering the chamber, and having a protrusion extending too far over the chamber axis 49 also would result in poor mixing because the exhaust gas would cling to the wall of the chamber opposite the wall adjoining the exhaust gas inlet port section 54.

The length of the mixing chamber is preferably at most about five times effective diameter of the mixing chamber, although a length of the chamber can be larger than this amount with an attendant decrease in mixing efficiency. The meaning of the term "effective diameter" in this disclosure refers to the diameter of an equivalent circular cross-section that has the same flow rate as the chamber cross-section, regardless as to whether that chamber cross-section is circular and non circular.

Figure 5:
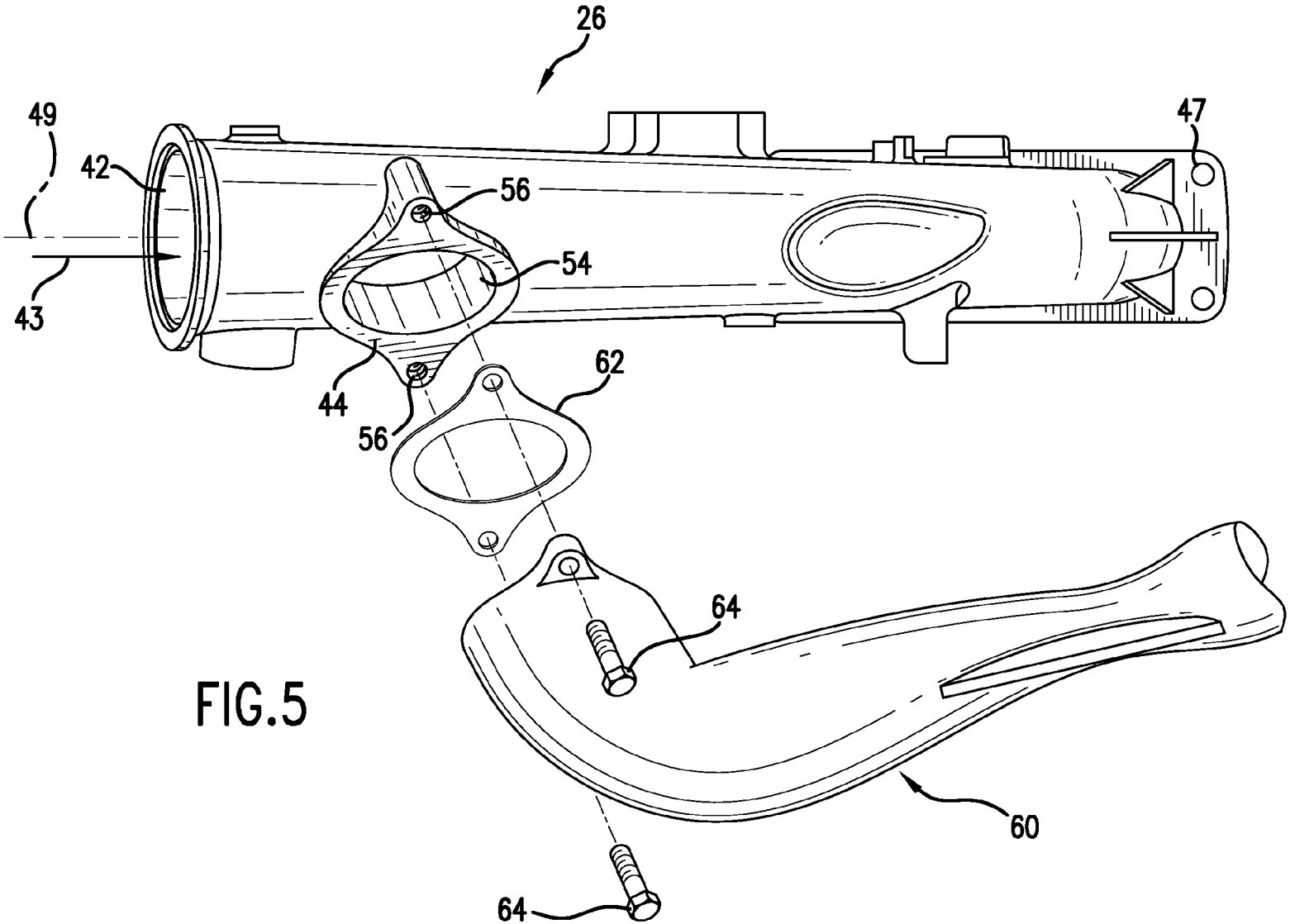
FIG. 5 is a perspective view of an air-exhaust gas mixer apparatus of FIG. 2 connecting to an exhaust gas conduit coupling section.
Figure 6B:
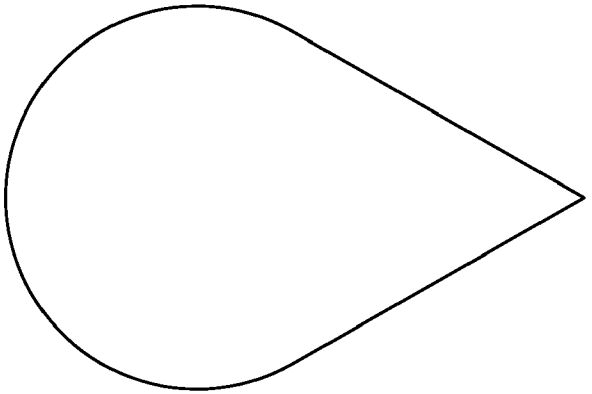
FIGS. 6*a*-6*d* each shows an example of a shape of a cross-section of an inlet port section projection according to exemplary embodiment.
Figure 6D:
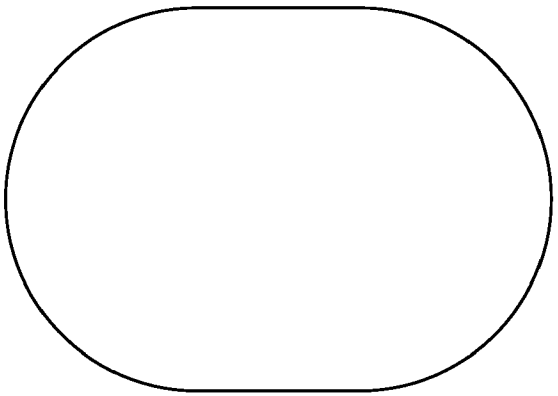
Figure 6A:
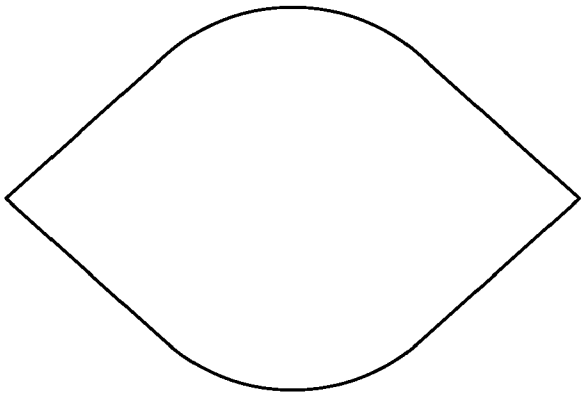
Figure 6C:
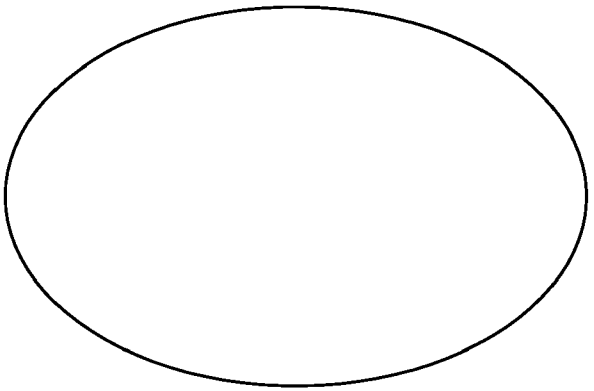

FIG. 5 shows an exemplary exhaust gas conduit coupling section 60 according to some embodiments for providing exhaust gas to the exhaust gas inlet port 44. The coupling section 60 has an elliptical opening that mates with the elliptical opening of the exhaust gas inlet port 44 and is secured to the exhaust gas inlet port 44 with bolts 64 and gasket 62 to provide a sealed connection.

It will be appreciated that the embodiments described and shown herein may be modified in a number of ways. For instance, other specific elongated cross-section shapes can be used for the outer surface of a mixing apparatus exhaust inlet port projection cross-section instead of an elliptical shape. FIGS. 6*a*-6*d* show exemplary shapes that an inlet port projection outside perimeter or annular cross-section may have in some embodiments to provide mixing and pressure head maintenance effects similar to those described above with respect to the ellipse. These examples include an "eye" like shape shown in FIG. 6*a*, a tear drop shape shown in FIG. 6*b*, an oval shape shown in FIG. 6*c*, and an oblong shape shown in FIG. 6*d*, although embodiments may use elongated shapes other that the depicted examples.

The elongated cross-sectioned air-exhaust mixer provides a simple solution for an acceptable mixing of EGR gas and intake air without high pressure head loss across the mixing system. Additionally, embodiments of an air-exhaust mixer apparatus can be cast as one integral piece such that the air intake inlet port, chamber and exhaust inlet port form one integrated casted piece. Such a mixer apparatus including an integrated intake air port and recirculated exhaust inlet port lowers costs because provision and assembly of a separate EGR mixer is not necessary. Furthermore, it should be readily recognized that the concepts described herein are not limited to one specific engine, but can be applied to any engine size and different types of engines, such as natural gas, diesel and gasoline engines.

Although a limited number of embodiments is described herein, one of ordinary skill in the art will readily recognize that there could be variations to any of these embodiments and those variations would be within the scope of the appended claims. Thus, it will be apparent to those skilled in the art that various changes and modifications can be made to the intake air-exhaust gas mixer apparatus described herein without departing from the scope of the appended claims and their equivalents.

What is claimed is:

1. An apparatus for mixing intake air and exhaust gases of an internal combustion engine, comprising:

a mixing body;

a chamber extending through said mixing body;

an air inlet port positioned in said mixing body to supply a stream of intake air to said chamber; and an exhaust inlet port positioned in said mixing body to deliver exhaust gas to the chamber, said exhaust inlet port including a section extending into the chamber, said section having an opening at a distal end thereof through which exhaust gas enters the chamber and including an outer surface exposed to the stream of intake air, wherein a cross-section of said outer surface of said extended exhaust inlet port section and said opening are elongated along a longitudinal axis of the chamber in the direction of flow of the intake air stream.

2. The apparatus of claim 1, wherein the chamber and exhaust inlet port are integratedly formed.

3. The apparatus of claim 1, wherein the cross-section is one of an elliptical, oval, oblong, tear and eye shape.

4. The apparatus of claim 1, further comprising an outlet port at the end of the chamber downstream from the inlet port, wherein said exhaust inlet port is located on the chamber between the inlet port and the outlet port.

5. The apparatus of claim 4, wherein the length of said chamber between the exhaust inlet port and the outlet port is at most 5 times the effective flow diameter cross-section taken along the direction of the longitudinal axis.

6. The apparatus of claim 1, wherein said section and said opening have a common central axis.

7. The apparatus of claim 6, wherein the common central axis is substantially perpendicular to the longitudinal axis of the chamber.

* * * * *